US006092288A

United States Patent [19]

Adachi

[11] Patent Number: 6,092,288

[45] Date of Patent: Jul. 25, 2000

[54] RAZOR HOLDER

[75] Inventor: Hidemi Adachi, Seki, Japan

[73] Assignee: Adachi Kogyo, Inc., Gifu-Ken, Japan

[21] Appl. No.: 09/156,680

[22] Filed: Sep. 18, 1998

[30] Foreign Application Priority Data

Sep. 18, 1997 [JP] Japan ..... 9-253118

[51] Int. Cl.[7] ..... B26B 21/10

[52] U.S. Cl. ..... 30/53; 30/30; 30/51; 30/337; D28/45

[58] Field of Search ..... 30/53, 298, 329, 30/335, 337, 30, 51; 528/45, 48

[56] References Cited

U.S. PATENT DOCUMENTS

| | | | |
|---|---|---|---|
| 868,588 | 10/1907 | Ward | 30/337 |
| 946,949 | 1/1910 | Ward | 30/337 |
| 1,359,666 | 11/1920 | Brandt | 30/30 |
| 2,036,749 | 4/1936 | Fry | 30/53 |
| 2,866,984 | 1/1959 | Plough | 30/298 |
| 3,372,481 | 3/1968 | Skinner | 30/233 |
| 4,037,322 | 7/1977 | Bresler | 30/53 |
| 4,612,705 | 9/1986 | Althaus | 30/53 |
| 4,665,615 | 5/1987 | Martinez | 30/53 |
| 5,009,003 | 4/1991 | Grange | 30/53 |

FOREIGN PATENT DOCUMENTS

| | | | |
|---|---|---|---|
| 2704797 | 11/1994 | France | 30/53 |

*Primary Examiner*—Hwei-Siu Payer
*Attorney, Agent, or Firm*—Jeffrey D. Myers; Joseph Barrera

[57] ABSTRACT

A hair razor holder (10) for combing off hair is disclosed, comprising a body (11, 12) having a blade cartridge housing means, and a finger ring (13). The finger ring (13) is provided slightly off the center of gravity (G) such that the holder (10) can smoothly turn on a finger inserted in the ring (13). The holder (10) additionally has a blade refreshing means (14, 23) which facilitates renewal of the blade edge without removing the cartridge (20) from the housing. The holder (10) can provide streamlined and safe hair combing off without requiring putting the holder (10) aside during work.

3 Claims, 6 Drawing Sheets

RAZOR HOLDER

BACKGROUND OF THE INVENTION

1. Field of the Invention

This invention generally relates to a hair razor. More particularly, this invention relates to a razor cartridge holder used for holding a replaceable hair combing razor blade cartridge.

2. Prior Art

Before introduction of a hair razor into the market, an ordinary facial razor was used to trim or comb off hair. Alternatively, one member 200 of a pair of barber's hair scissors having a finger holder ring 203 provided on the proximal end thereof such as shown in FIG. 10 was utilized at a barbershop to comb off hair.

Many conventional hair trimming razors and hair combing razors have such a finger holder ring on the rear or proximal and of their handle portions, through which the little finger of the hand holding the razors may be optionally inserted to help securely hod the razors while in use.

In FIG. 8, a conventional hair razor 100 for combing off hair is shown. The razor 100 has a body comprising a blade holder portion 101 with a blade member mounted along the hair facing edge thereof and a handle portion 102 with a finger ring 103 provided on the proximal and thereof, which corresponds to the aforementioned finger holder ring 203 shown in FIG. 10. The blade holder portion 101 is provided with a plurality of parabolic protrusions 22 provided along the hair facing edge thereof to cover the edge of the blade 30 partially at intervals so as to provide hair combing off when applied on hair like a comb (FIG. 11).

Such a blade member 20 is often provided in a replaceable cartridge form such as shown in FIG. 11, comprising a blade 30, a cover case 21 to house the blade 30, and parabolic protrusions 22 which are generally provided in unity with the cover case 21. The blade cartridge 20 is attachable to and detachable from the blade holder portion 101 (FIG. 8).

In FIG. 12 is shown another type of blade cartridge 20. The exposed portions A and covered portions B of the blade edge can be interchanged by sliding the cover case 21 or protrusions 22 relative to the blade 30 by pressing the exposed blade portion 30 within a cut 23 formed on an end of the cover case 21 with a finger tip or fingernail, for instance, so as to extend or double the life of the blade 30. FIG. 13 shows the displaced and renewed state of the blade cartridge 20. Such displacement or refreshment of the blade edge 30 is not so readily provided with the conventional razor holder 100 partly because the cartridge 20 is mounted in the blade holder portion 101 when such renewal is required or desired. For renewal of the blade edge, the cartridge 20 must be first removed from the holder portion 101.

Such a razor 100 is used to comb off hair as shown in FIG. 9 by a user or barber who is right handed. For a left hander, the drawing should appear symmetrically. First, a small bundle or portion of hair is separated from the rest and lifted using a conventional comb. The bundle on the left hand is combed well with the comb until the hair bundle is flattened neatly on the left hand. Then the flattened hair held on the left hand is combed off with the razor 100, and combed again with the comb neatly for subsequent combing off with the razor 100. The foregoing process is repeated many a time until the whole hair has been neatly treated.

During these busy processes, the user or barber must interchange the razor 100 and the comb very frequently.

Conventionally, a movable side table or cart with a flat top (not shown) is usually utilized for laying down thereon the razor and comb alternately when not in use to save working time and trouble. Some users may utilize their jacket pockets for the same purpose. A skilled user may never lay down the razor 100 and keep the razor in his right hand (or left hand) during the whole processes, however, the razor 100 in his hand may accidentally slip off his hand (if he does not insert his little finger through the finger ring 103) when he is using the comb, or requires him to hold the razor 100 tightly and securely to prevent such slippage. If he holds the razor 100 on his little finger inserted through the finger ring 103, the razor 100 will naturally hang out far from the little finger, and hinder his work.

In addition, to switch the razor 100 between its use position and nonuse position within his hand quickly and safely requires extra skill.

Accordingly, it is an object of the present invention to provide a hair razor holder which can be very conveniently and safely used.

It is another object of the present invention to save working time and trouble inherently required and caused from frequently interchanging a hair razor and a comb.

It is another object of the present invention to provide quick and safe switching between a use position and a nonuse position of a hair razor within a hand.

It is still another object of the present invention to additionally provide quick and easy refreshment of the blade edge of a hair razor while in use.

SUMMARY OF THE INVENTION

Such objects can be readily achieved with a hair razor blade cartridge holder (razor holder) of the present invention, having a finger (holder) ring at a middle portion of the handle portion of the razor holder instead of the proximal end of the razor holder, and optionally having a blade edge renewal means.

The finger ring of the present invention is provided proximate to or slightly off the center of gravity of the whole razor holder including the blade cartridge so as to provide balanced and smooth turning of the razor holder on a finger in the finger ring. Unlike a conventional hair razor having such a finger ring on its proximal and such as shown in FIG. 8, which is far off the center of gravity, the turned razor holder of the present invention can be securely and safely held in a hand as shown in FIG. 5 while the user is using a comb with the same hand (FIG. 6).

The razor holder of the present invention can be provided with a blade refreshing means which facilitates easy pushing in or sliding of the blade in the blade cartridge while the cartridge is mounted in the razor holder. Such a means can comprise an outer cut 14 shown in FIG. 2 formed on the distal end of the razor holder, which mates with an inner cut 23 formed on the distal end of the blade cartridge when the cartridge is properly mounted in the holder.

Such sliding may be conveniently provided by pressing the exposing portion of the blade within the cuts 14 and 23 with a plate projection 51 provided in a cartridge box or case 50 shown in FIG. 7.

Other objects and features of the present invention can be readily appreciated by a person skilled in the art from the following detailed description and drawings that accompany.

DETAILED DESCRIPTION OF PREFERRED EMBODIMENT

Figure 1:
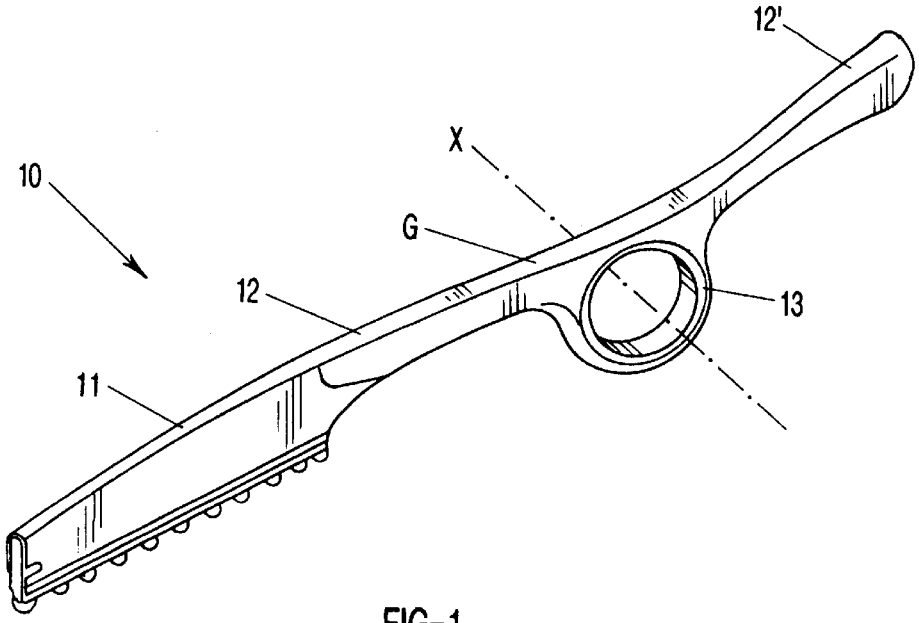
FIG. 1 is a perspective view of a razor holder incorporating a blade cartridge according to an embodiment of the present invention.

In FIG. 1 is shown a razor holder 10 according to an embodiment of the present invention, comprising a blade holder portion 11 and a handle portion 12 having a handle sub-portion 12' and a finger ring 13. The finger ring 13 has such dimensions as to allow a middle finger to freely turn within the ring 13. The blade holder portion 11 houses a blade cartridge 20. The finger ring 13 is provided under a middle portion of the handle portion 12 or proximate to the center of gravity G of the holder 10 or slightly off the center of gravity so as to provide smooth and balanced turning of the razor holder 10 about the center axis X of the ring. It is understood by a person skilled in the relevant art that the weight of the sub-portion 12' and the ring 13 is provided so as to balance the rest with the cartridge 20 mounted in the blade holder portion 11 at the center of gravity G.

The middle finger of the user's hand holding the holder 10 can be smoothly inserted into the ring 13 as shown throughout the accompanying drawings for the present invention such that the razor holder 10 can freely turn on the middle finger just as a pistol can turn on an index finger (not shown). It is to be understood that the index finger or the ring finger may be used instead of the middle finger, if the user so desires.

Figure 2:
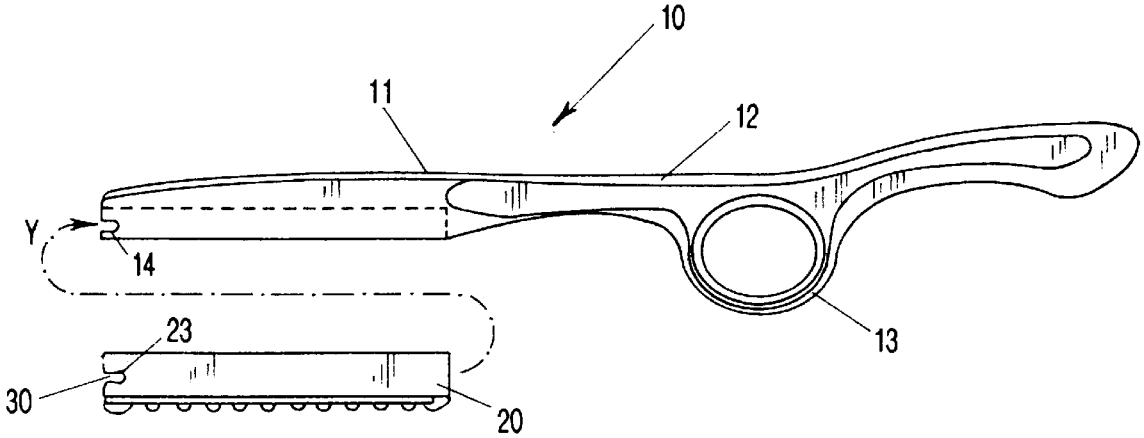
FIG. 2 is a side elevational view of the razor holder of FIG. 1, from which the blade cartridge is dismounted.

The blade holder portion 11 is provided with a blade cartridge housing means indicated by broken lines in FIG. 2. The blade cartridge 20 is mounted in the holder portion 11 by sliding and inserting the cartridge 20 from the distal end of the holder portion 11 as indicated by a curbed arrow Y. The cartridge 20 is fixedly held within the housing means.

Figure 3:
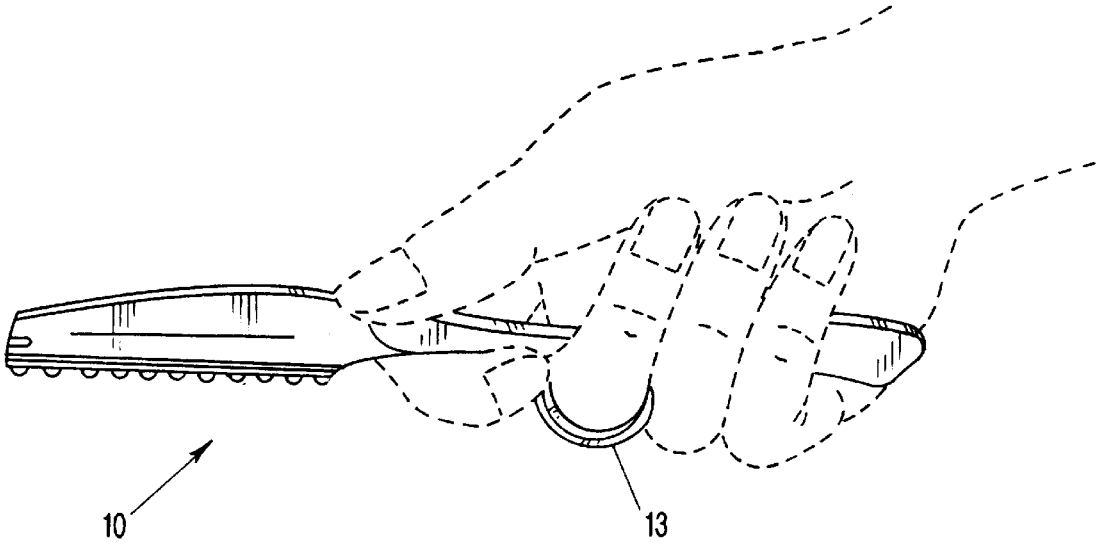
FIG. 3 shows an example of how the razor holder is held in a hand.
Figure 4:
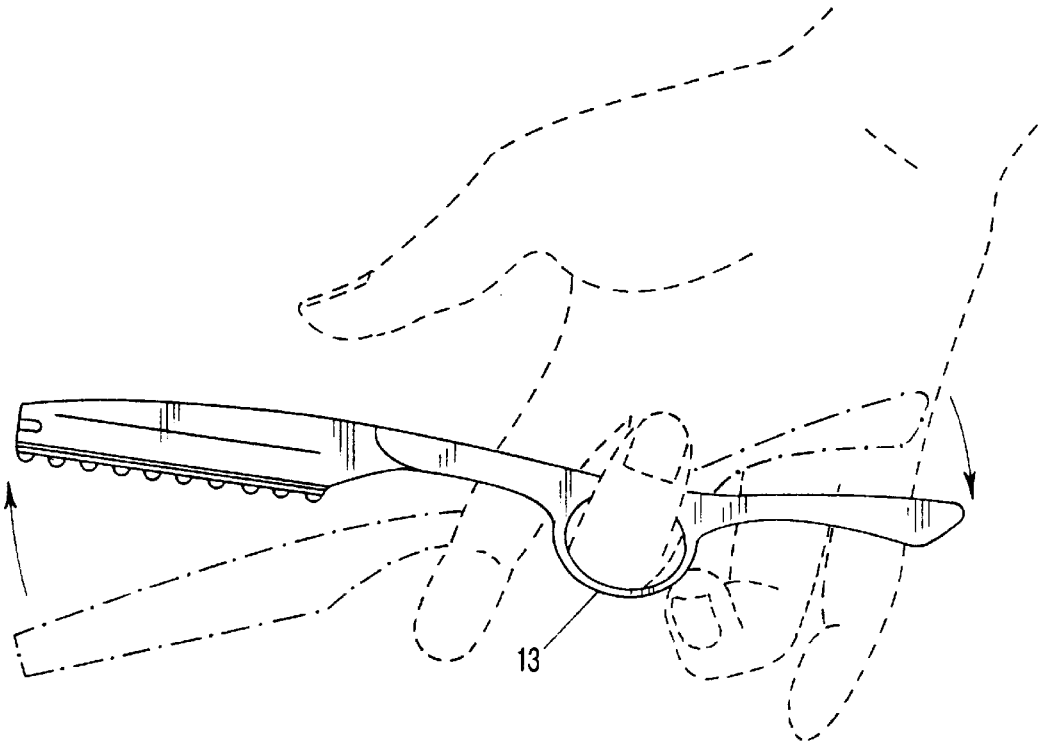
FIG. 4 shows an example of how the razor holder is turned within the hand.
Figure 5:
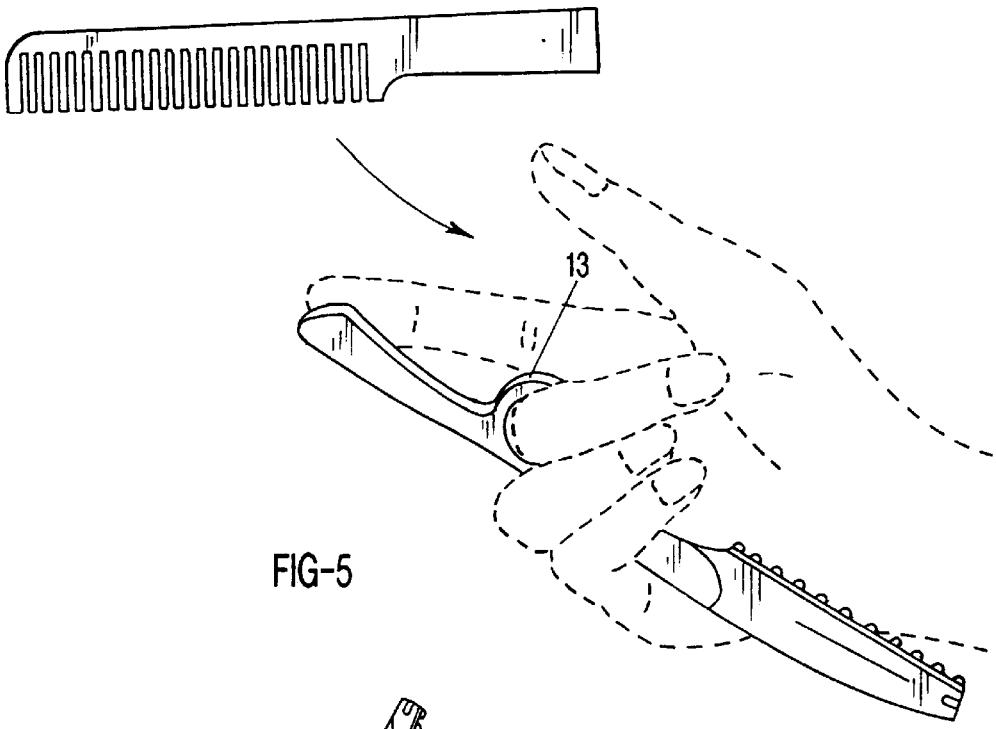
FIG. 5 shows and example of how the razor is held in the hand when it is not used.
Figure 6:
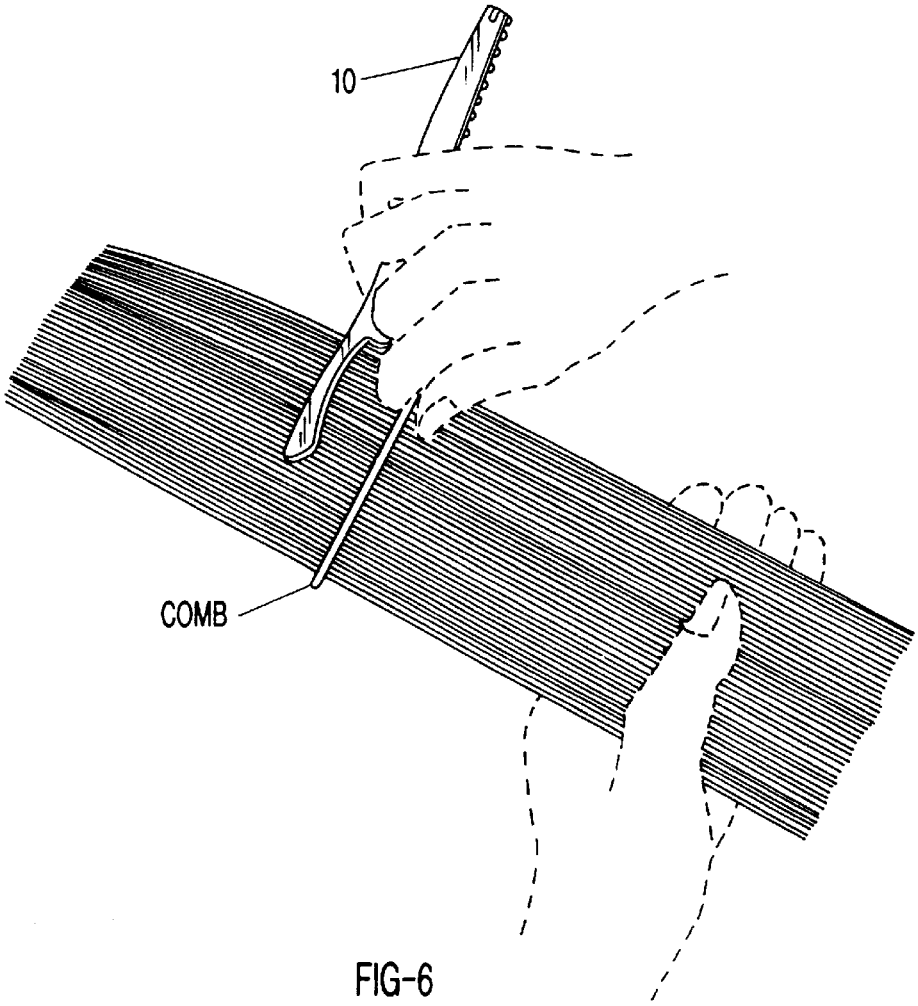
FIG. 6 shows an example of how hair is combed with a comb held in the hand together with the razor holder.

FIG. 3 shows an example of how the razor holder 10 is held in a hand to comb off hair. It is to be understood that a left hander will hold the razor holder 10 in his left hand (not shown). The razor holder 10 will be turned about the middle finger in the direction indicated by arrows in FIG. 4 to its nonuse position. The razor holder 10 will be eventually held in the hand as shown in FIG. 5 when a comb is held in the hand and used to comb hair as shown in FIG. 6.

The whole process can be performed very easily, smoothly and safely as well as quickly. A skilled or professional barber can hold the razor holder 10 and the comb together for alternative use, which can generate a professional and refined impression upon his customers.

The blade holder portion 11 of the razor holder 10 may be additionally provided with an outer cut 14 formed on the distal end thereof as shown in FIGS. 1 and 2, which can mate with an inner cut 23 formed on the distal end of the blade cartridge 20 as shown in FIG. 2 when the cartridge 20 is fixedly housed in the blade holder portion 11.

Figure 7:
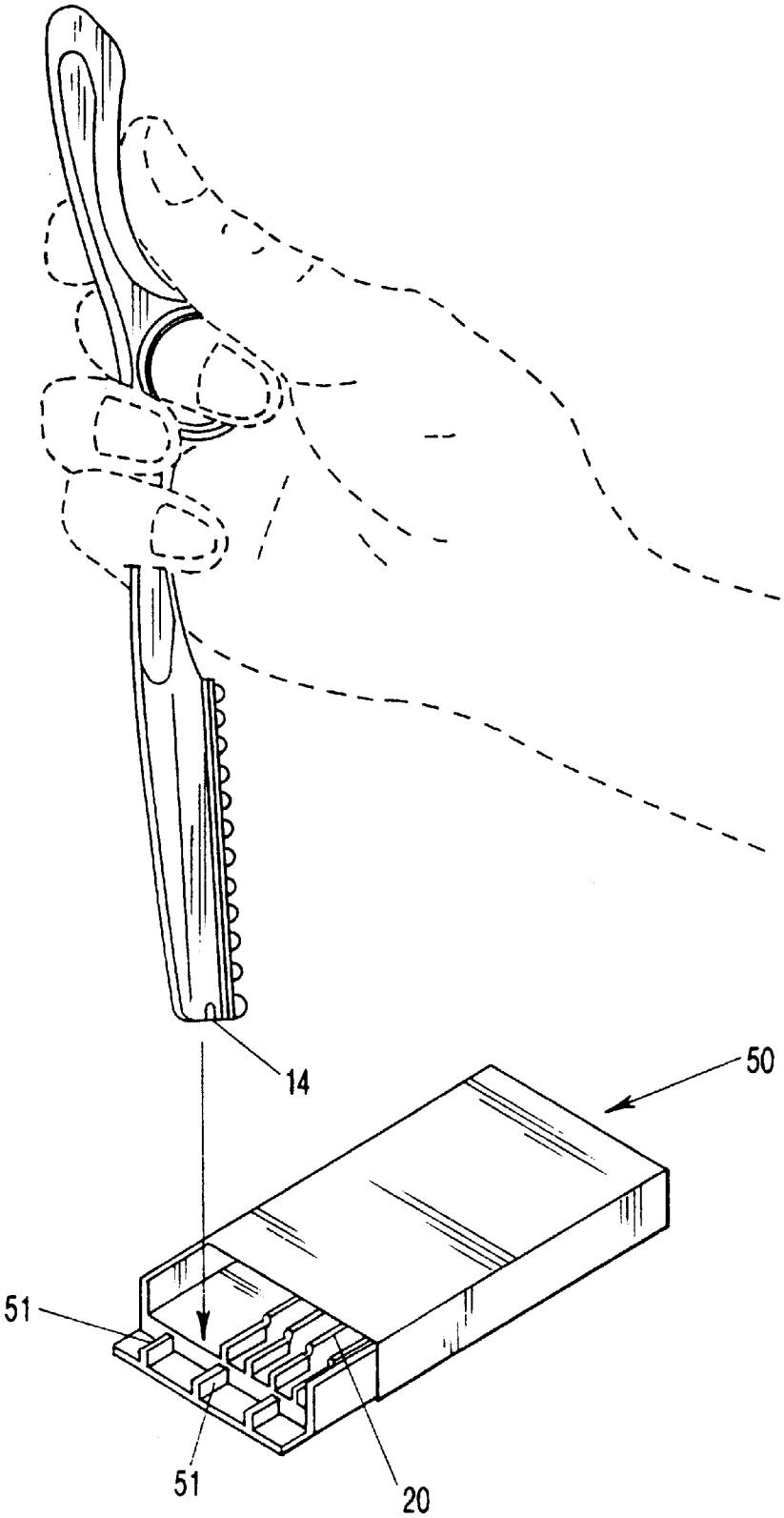
FIG. 7 shows an example of how the blade edge is refreshed using a plate projection provided on a blade cartridge case.
Figure 8:
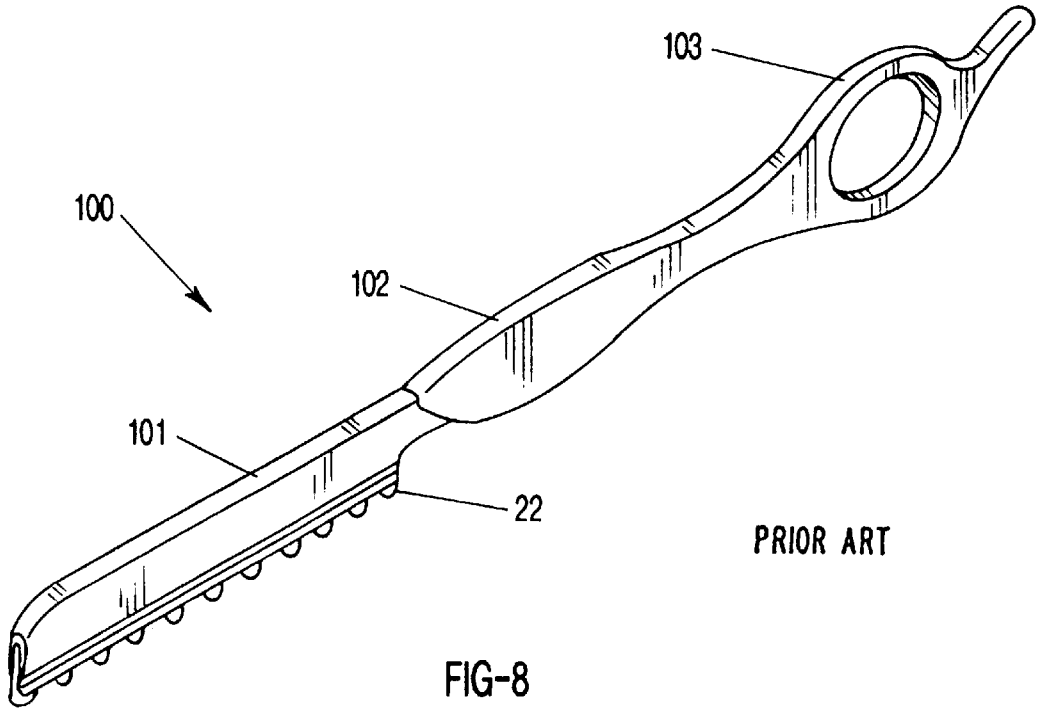
FIG. 8 is a perspective view of a conventional hair razor holder.
Figure 9:
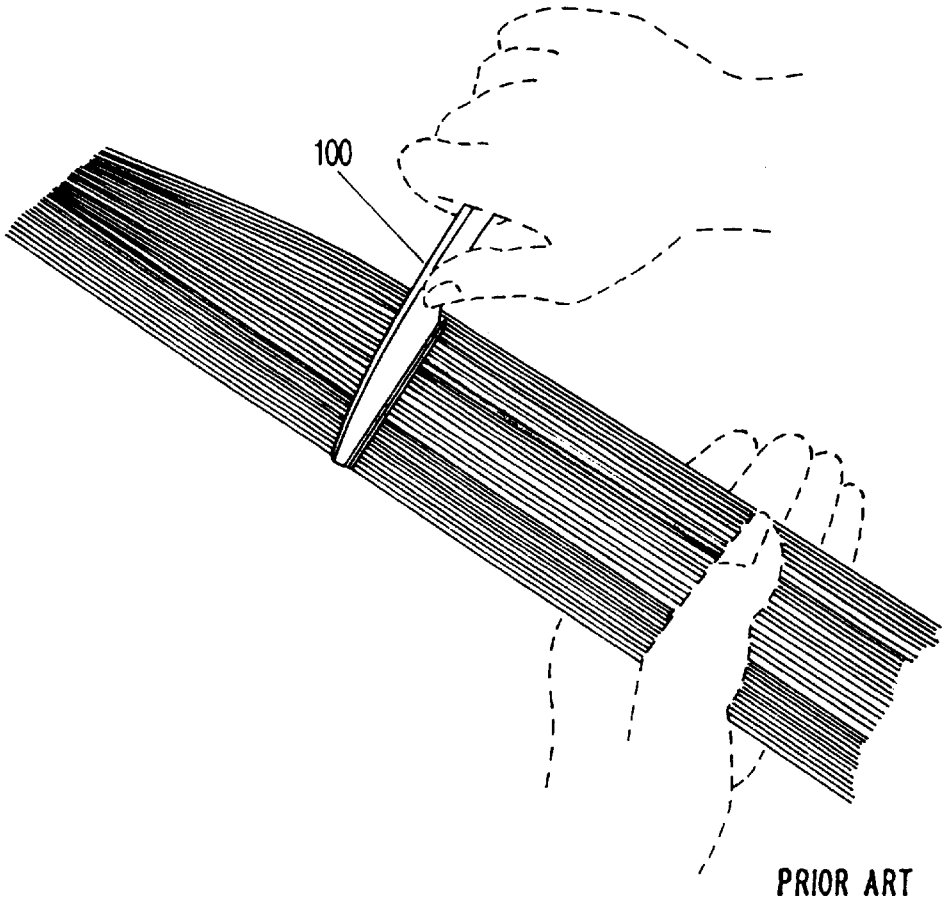
FIG. 9 shows how the conventional razor holder of FIG. 8 is used on hair.
Figure 10:
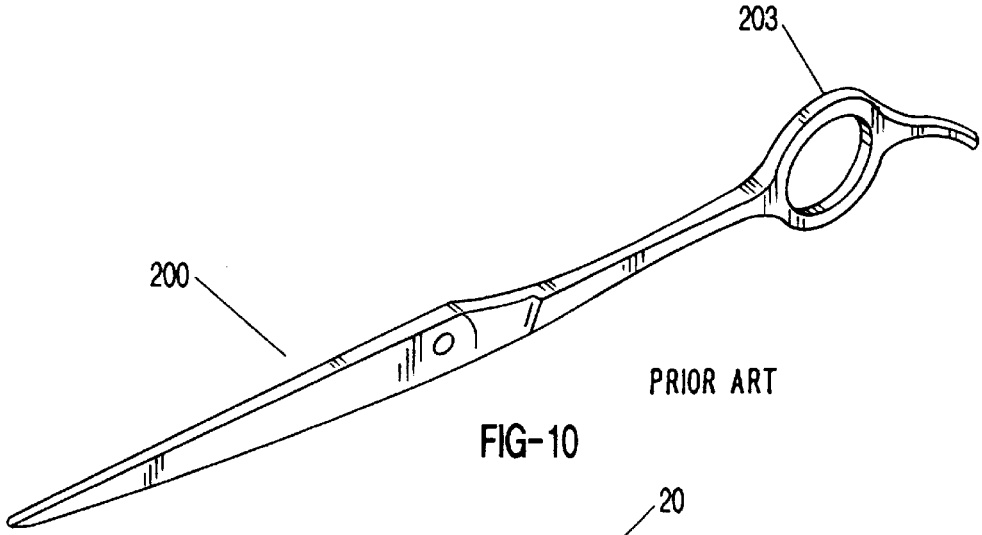
PRIOR ART FIG-10
FIG. 10 is a perspective view of one member of a pair of scissors which is conventionally used to comb off hair.
Figure 11:
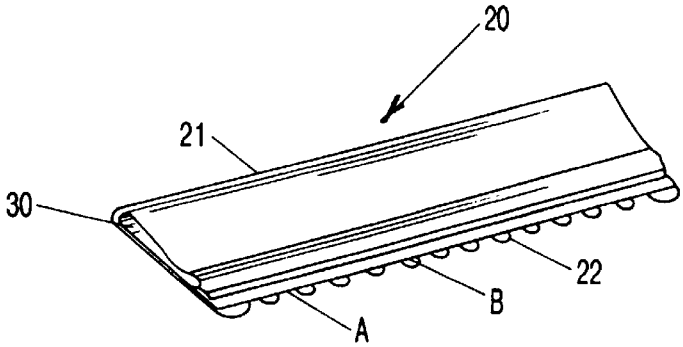
PRIOR ART FIG-11
FIG. 11 is a perspective view of a conventional blade cartridge.
Figure 12:
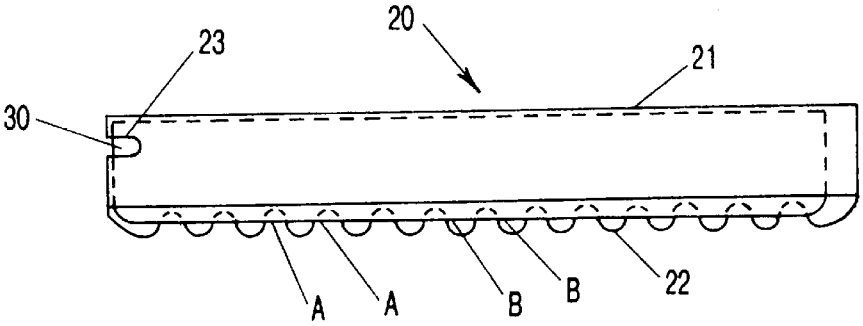
PRIOR ART FIG-12
FIG. 12 is a side view of another conventional blade cartridge which can be advantageously used on the razor holder of the present invention.
Figure 13:
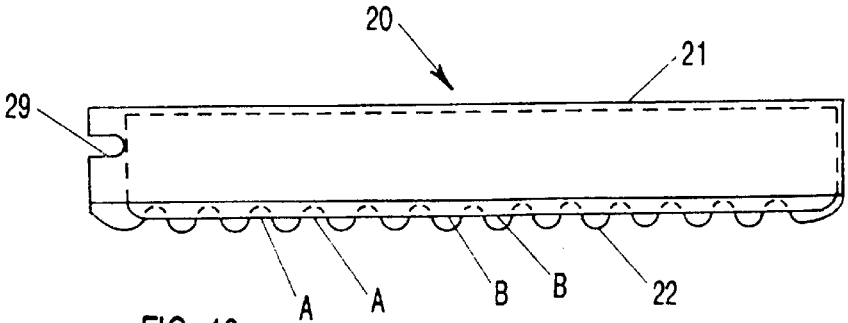
FIG-13 PRIOR ART
FIG. 13 is a side view of the blade cartridge of FIG. 12, where the blade has been pressed within the case to its refreshed state.

A cartridge box or case 50 shown in FIG. 7 can store a plurality of blade cartridges 20, which can be provided with plate projections 51. The mated cuts 14 and 23 can mate the projection 51. The user of the razor holder 10 presses the exposed portion of the blade 30 within the cuts 14 and 23 against the projection 51 so that the blade 30 in the cartridge 20 can slide further into the cartridge 20 and its edge is refreshed. As such, the renewal of the blade edge 30 can be performed very easily without requiring removal of the cartridge 20 from the holder portion 11.

While the present invention is illustrated using the embodiments, it is to be understood that various modification thereto can be made by a person skilled in the art within the spirit and scope of the present invention. Therefore, the foregoing embodiments are intended only to illustrate the invention, and not to limit the invention. The true scope of the present invention is found only in the following claims.

What is claimed is:

1. A hair razor for combing off hair, comprising:

a blade holder portion having a blade cartridge housing means wherein said blade holder portion is provided with a first cut on a distal end thereof;

a handle portion provided in unity with said blade holder portion; and a blade cartridge mounted in said blade cartridge housing means wherein said blade cartridge is provided with a second cut on a distal end thereof such that said first cut on said blade holder portion and said second cut coincide when said blade cartridge is mounted in said blade holder portion thus exposing a portion of a blade housed in said blade cartridge in said first and second cuts.

2. A hair razor according to claim 1, in combination with a blade cartridge case comprising at least one plate projection to allow said blade to be pushed further into said blade cartridge by contacting an exposed portion of said blade against said plate projection.

3. A hair razor according to claim 1 wherein said handle portion further comprises a finger ring projected in the same direction as the cutting edge of said blade when said blade is engaged in said blade holder portion.

* * * * *